United States Patent [19]

Johncock et al.

[11] Patent Number: 4,721,663

[45] Date of Patent: Jan. 26, 1988

[54] ENHANCEMENT LAYER FOR NEGATIVELY CHARGED ELECTROPHOTOGRAPHIC DEVICES

[75] Inventors: Annette Johncock, Royal Oak; Stephen J. Hudgens, Southfield, both of Mich.

[73] Assignee: Energy Conversion Devices, Inc., Troy, Mich.

[21] Appl. No.: 900,202

[22] Filed: Aug. 25, 1986

Related U.S. Application Data

[63] Continuation-in-part of Ser. No. 769,106, Aug. 26, 1985, abandoned.

[51] Int. Cl.[4] ..... G03G 5/14

[52] U.S. Cl. ..... 430/65; 430/66; 430/67

[58] Field of Search ..... 430/57, 65, 66, 67

[56] References Cited

U.S. PATENT DOCUMENTS

| | | | |
|---|---|---|---|
| 4,378,417 | 3/1983 | Maruyama et al. | 430/57 |
| 4,418,132 | 11/1983 | Yamazaki | 430/66 X |
| 4,443,529 | 4/1984 | Kanbe et al. | 430/65 |
| 4,477,549 | 10/1984 | Fujimaki et al. | 430/66 X |
| 4,544,617 | 10/1985 | Mort et al. | 430/66 X |
| 4,557,987 | 12/1985 | Shirai et al. | 430/66 X |

FOREIGN PATENT DOCUMENTS

| | | | |
|---|---|---|---|
| 58-88753 | 5/1983 | Japan | 430/67 |
| 59-67553 | 4/1984 | Japan | 430/65 |

*Primary Examiner*—Roland E. Martin

*Attorney, Agent, or Firm*—Marvin S. Siskind; Richard M. Goldman

[57] ABSTRACT

An improved enhancement layer operatively disposed between the top protective layer and the photoconductive layer of an electrophotographic device. The enhancement layer is specifically tailored from a semiconductor alloy material designed to substantially prevent charge carriers from being caught in deep midgap traps as said carriers move toward the surface of the electrophotographic device from the photoconductive layer thereof.

10 Claims, 2 Drawing Figures

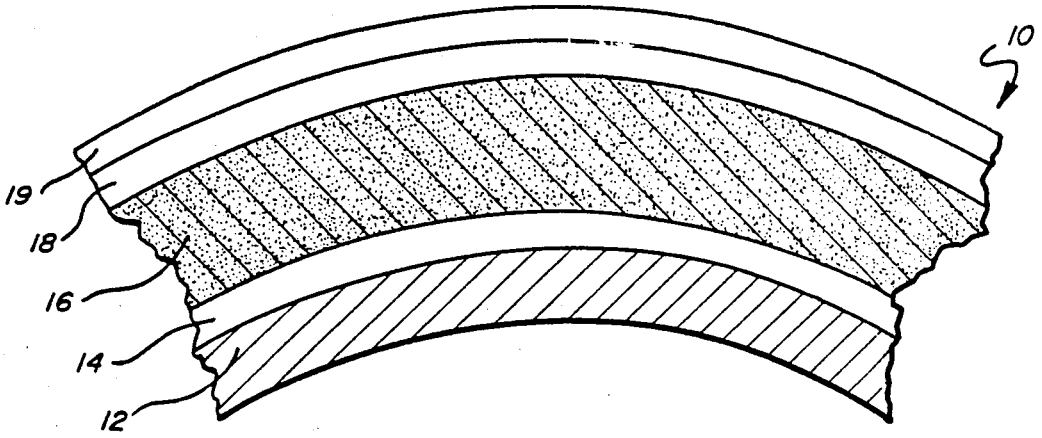
FIG. 1
FIG. 2
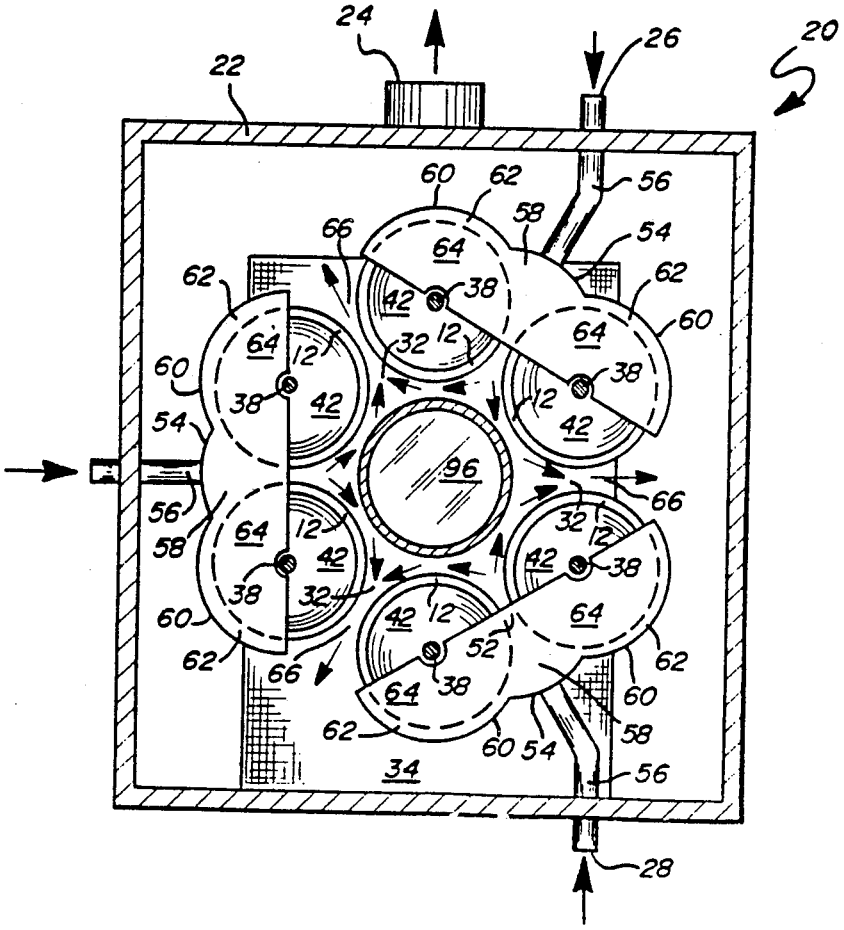

ENHANCEMENT LAYER FOR NEGATIVELY CHARGED ELECTROPHOTOGRAPHIC DEVICES

RELATED APPLICATION

This is a continuation-in-part of parent U.S. patent application Ser. No. 769,106, filed Aug. 26, 1985, now abandoned.

FIELD OF THE INVENTION

This invention relates generally to electrophotographic devices and more particularly to an improved, enhancement layer which is specifically tailored to substantially eliminate charge fatigue in negatively charged electrophotographic photoreceptors by intentionally doping and simultaneously fixing the Fermi level position of that enhancement layer so as to substantially reduce charge carrier trapping in deep midgap states.

BACKGROUND OF THE INVENTION

The instant invention relates to improved enhancement layers for use in electrophotographic imaging processes. The improved enhancement layer of the instant invention is fabricated from semiconductor alloy material, said material characterized by a decreased number of deep midgap defect sites in which charge carriers can be trapped. By decreasing the number of deep defect sites likely to trap charge carriers, the rate of charge carrier emission from those traps is increased and not only is the problem of charge fatigue prevalent in negatively charged electrophotographic media of the prior art virtually eliminated, but the problem of image flow is also virtually eliminated.

Electrophotography, also referred to generically as xerography, is an imaging process which relies upon the storage and discharge of an electrostatic charge by a photoconductive material for its operation. A photoconductive material is one which becomes electrically conductive in response to the absorption of illumination; i.e., light incident thereupon generates electron-hole pairs (referred to generally as "charge carriers"), within the bulk of the photoconductive material. It is these charge carriers which provide for the passage of an electrical current through that material for the discharge of the static electrical charge (which charge (either positive or negative) is stored upon the outer surface of the electrophotographic media in the typical electrophotographic process).

First the structure and then the operation of a typical electrophotographic photoreceptor will be explained so that the operation and advantages of the instant invention may be fully appreciated. It is to be noted, however, that the improved enhancement layer of the subject invention is not limited to use with "typical" photoreceptors, but is equally adapted to be used with any photosensitive material which undergoes a change in any characteristic thereof under the influence of electromagnetic radiation, which characteristic provides for said material to have image reproduction capabilities.

As to the structure: A typical photoreceptor includes a cylindrically-shaped, electrically conductive substrate member, generally formed of a metal such as aluminum. Other substrate configurations, such as planar sheets, curved sheets or metallized flexible belts may likewise be employed. The photoreceptor also includes a photoconductive layer, which, as previously described, is formed of a photoresistive material having a relatively low electrical conductivity in the dark and a relatively high electrical conductivity under illumination. Disposed between the photoconductive layer and the substrate member is a blocking layer, formed either by the oxide naturally occuring on the substrate member, or from a deposited layer of semiconductor alloy material. As will be discussed in greater detail hereinbelow, the blocking layer functions to prevent the flow of unwanted charge carriers from the substrate member into the photoconductive layer. If not for the presence of the blocking layer, charge carriers flowing from the substrate into the photoconductive layer could neutralize the charge stored upon the top surface of the photoreceptor. A typical photoreceptor also generally includes a top protective layer disposed upon the photoconductive layer to stabilize electrostatic charge acceptance against changes due to adsorbed chemical species and to improve the photoreceptor durability. Finally, a photoreceptor also may include an enhancement layer operatively disposed between the photoconductive layer and the top protective layer, the enhancement layer adapted to substantially prevent charge carriers from being caught in deep midgap traps and hence prevent charge fatigue in the photoreceptor.

In operation of the electrophotographic process: the photoreceptor must first be electrostatically charged in the dark. Charging is typically accomplished by a corona discharge or some other such conventional source of static electricity. An image of the object to be photographed, for example a typewritten page, is then projected onto the surface of the charged electrophotographic photoreceptor. Illuminated portions of the photoconductive layer, corresponding to the light areas of the projected image, become electrically conductive and pass the electrostatic charge residing thereupon through to the electrically conductive substrate thereunder, which substrate is generally maintained at ground potential. The unilluminated or weakly illuminated portions of the photoconductive layer remain electrically resistive and therefore continue to be proportionally resistive to the passage of electrical charge to the grounded substrate. Upon termination of the illumination, a latent electrostatic image remains upon the photoreceptor for a finite length of time (the dark decay time period). This latent image is formed by regions of high electrostatic charge (corresponding to dark portions of the projected image) and regions of reduced electrostatic charge (corresponding to light portions of the projected image).

In the next step of the electrophotographic process a fine powdered pigment bearing an appropriate electrostatic charge and generally referred to as a toner, is applied (as by cascading) onto the top surface of the photoreceptor where it adheres to portions thereof which carry the high electrostatic charge. In this manner a pattern is formed upon the top surface of the photoreceptor, said pattern corresponding to the projected image. In a subsequent step the toner is electrostatically attracted and thereby made to adhere to a charged receptor sheet which is typically a sheet of paper or polyester. An image formed of particles of toner material and corresponding to the projected image is thus formed upon the receptor sheet. In order to fix this image, heat and/or pressure is applied while the toner particles remain attracted to the receptor sheet. The foregoing describes a process which is the basis of many commercial systems, such as plain paper copiers and xeroradiographic systems.

It should be clear from the foregoing discussion that in order to obtain high resolution copies, it is desirable that the electrophotographic photoreceptor accept and retain a high static electrical charge in the dark; it must also provide for the flow of the charge carriers which form that charge from portions of the photoreceptor to the grounded substrate, or from the substrate to the charged portions of the photoreceptor under illumination; and it must retain substantially all of the initial charge for an appropriate period of time in the non-illuminated portions without the substantial decay thereof. Image-wise discharge of the photoreceptor occurs through the photoconductive process previously described. However, unwanted discharge may occur via charge injection at the top or bottom surface and/or through thermal charge carrier generation in the bulk of the photoconductor material.

A major source of charge injection is at the metal substrate/semiconductor alloy material interface. The metal substrate provides a virtual sea of electrons available for the injection into and subsequent neutralization of, for example, the positive static charge on the surface of the photoreceptor. In the absence of any impediment, these electrons would immediately flow into the photoconductive layer; accordingly, all practical electrophotographic media include a bottom blocking layer disposed between the substrate and the photoconductive member. This bottom blocking layer is particularly important for electrophotographic devices which employ photoconductors with dark conductivities greater than $10^{-13}ohm^{-1}cm^{-1}$. As mentioned hereinabove, in some cases the blocking layer may be formed by native oxides occuring upon the surface of the substrate, as for example a layer of alumina occuring on aluminum. In other cases, the blocking layer is formed by chemically treating the surface of the substrate. Since it is particularly important to the electrophotographic copying process to have the semiconductor alloy material exhibit unipolar charging characteristics, an important class of blocking layers is formed by depositing a layer of semiconductor alloy material of appropriate conductivity type onto the substrate to give rise to substantially diode-like blocking conditions.

In order to better understand the manner in which the blocking layers operate, it will be helpful to review, in greater depth, a portion of the physics involved in the blocking layer phenomenon. As previously mentioned, the blocking layer must inhibit the transport and subsequent injection of the appropriate charge carrier (electrons for a positively charged drum) principally from the metal substrate into the body of the photoreceptor. This is accomplished in the doped semiconductor blocking layer by establishing a condition in which the minority charge carrier drift range, mu tau E, is smaller than the blocking layer thickness. Here, mu is the minority carrier mobility, tau is the minority carrier lifetime and E is the electric field strength. One can, for instance, substantially reduce the mu tau product for electrons by doping the blocking layer p-type. The excess holes present in the doped blocking layer greatly increase the probability of electron-hole recombination, thereby reducing the electron lifetime, tau. In effect a condition is achieved whereby electrons injected from the metal substrate recombine with holes in the p-type blocking layer before they are able to drift into the bulk of the semiconductor alloy material from which the photoreceptor is fabricated to be swept through the top surface and neutralize the static charge thereon. However, while doping can serve to limit the mu tau product for the desired carrier, it can also give rise to deep electronic energy levels in the energy gap of said semiconductor alloy material. This is particularly true for semiconductor alloy material, such as amorphous silicon alloys, in which the efficiency of substitutional doping is not high. These deep levels can become the source of thermally generated charge carriers or they can, if sufficiently numerous, provide a parallel path for the hopping conduction of electrons through the doped layers. Either of these phonomena can serve to compromise the blocking function of the doped layers of semiconductor alloy material.

It should therefore be apparent that amorphous silicon alloys have demonstrated great utility as the material from which to fabricate electrophotographic media as compared to the chalcogenide materials from which such media were previously fabricated. Even the methodology of fabrication has become economical in view of applicants' assignee's use of microwave frequencies in a process disclosed for the first time in commonly assigned U.S. Pat. No. 4,504,518 entitled "Method Of Making Amorphous Semiconductor Alloys And Devices Using Microwave Energy", said process having been specifically adapted for the mass production of electrophotographic media in U.S. patent application Ser. No. 580,086 entitled "Method And Apparatus For Making Electrophotographic Devices" (the disclosures of both of these patents being incorporated herein by reference). However, other areas of concern still remain in the fabrication of an electrophotoconductive member capable of high speed, high resolution copying. One area of particular concern resides in the inherent property exhibited by the semiconductor alloy material from which electrophotoconductive layers of prior art constructions were fabricated, e.g., the inherent property of that material to trap charge carriers in deep defect sites in the energy gap thereof as they reach the interface between the photoconductive layer and the top protective layer. This condition has become known as charge fatigue and occurs when the failure of the charge carriers to quickly vacate traps results in a breakdown of the blocking function of the top protective layer. Once the top protective layer breaks down, charge carriers are able to freely flow therethrough in an attempt to neutralize the electrostatic charge residing on the surface of the electrophotographic medium. This problem, as well as Applicants' solution with respect to negatively charged media, will be explained in detail in the following paragraphs.

In the course of operation of the typical electrophotographic process, described above, a positive corona charge is placed on the outer surface (the exposed surface of the top protective layer) of the electrophotographic media. The initial reaction of the photoconductive layer of the electrophotographic media to the application of this positive charge to the top surface thereof is to have any free electrons from the bulk be swept toward that surface in an attempt to neutralize the positive charge residing thereon. However, in the movement of these electrons from the bulk of the photoconductive layer to the outer surface of the top protective layer (on which surface the positive charge carriers have accumulated), said electrons encounter deep trap sites such as midgap defect states. While these trap sites are located throughout the bulk of the photoconductive layer, they are of particular importance when they reside near the interface of the photoconductive layer and the top protective layer. This is because the blocking function (the inability of the positive charge carriers electrostatically positioned on the periphery of the top protective layer to penetrate that layer) will cease to be effective (will "breakdown") when an electrical field of sufficient strength is placed across the top protective layer. Obviously, a given density of negative charge carriers trapped near the aforementioned interface of the top protective layer and the photoconductive layer will generate a sufficiently strong electrical field across the top protective layer to cause breakdown, whereas the same number of negative charge carriers trapped in the bulk thereof will not.

Further, trapping sites located deep in the energy gap of a semiconductor alloy material release trapped charge carriers at a much slower rate than do sites located closer to one of the bands. This results from the fact that more thermal energy is required, for example, to re-excite a trapped electron from the deep sites which exist near the middle of the energy gap to the conduction band than is required to re-excite an electron from the shallower sites which exist closer to the conduction band or to re-excite a trapped electron from the deep sites which exist near the middle of the energy gap to the valence band than is required to re-excite an electron from the shallower sites which exist closer to the valence band. The slow release rate from deep traps gives rise to a higher equilibrium trap occupancy and thus a higher electric field distribution.

It is important to note that in the fabrication of the typical electrophotographic photoreceptor which operates with a positive corona charge applied to outer surface thereof, the photoconductive layer thereof is made from a "pi-type" silicon:fluorine:hydrogen:boron alloy. As used herein, "pi-type" will refer to semiconductor alloy material, the Fermi level of which has been displaced from its undoped position closer to the conduction band to a position approximately "midgap". Further note that as used herein, the term "midgap" will be used to define a point in the energy gap of a semiconductor alloy material which is positioned approximately half-way between the valence band and the conduction band (in the case of 1.8 eV amorphous silicon:fluorine:hydrogen:boron alloy this midgap position is about 0.9 eV from each of the bands). It is necessary to make the photoconductive layer of the photoreceptor pi-type because the typical "intrinsic" amorphous silicon:hydrogen:fluorine alloy as deposited in a glow discharge decomposition process is slightly "nu-type" (the Fermi level of that material is slightly closer to the conduction band than to the valence band) and in a positive corona charge electrophotographic process, the movement of charge carriers through the photoconductive layer under illumination must be maximized while miminizing the thermal generation of charge carriers.

It is to be noted that when the Fermi level is positioned at midgap (as after the addition of the p-dopant to the silicon:fluorine:hydrogen alloy material), electrons moving through a charged electrophotographic device utilizing said pi-type material will encounter unoccupied deep traps from which they cannot readily emerge. This is because the deepest unoccupied electron trap sites in a layer of semiconductor alloy material lie at or near the Fermi level and in this Pi type material this energy coincides with midgap. The thermal energy required to release an electron from a deep trap is exponentially dependent on the depth of that trap. More particularly, the time which a trapped electron will wait, on average, before being thermally emitted from any trap is given by the formula:

$$t = \frac{1}{V_0 \operatorname{Exp} - (\Delta E/kT)}$$

where "$\nu_0$" is the number of times a trapped electron will attempt to escape per second, "$\Delta E$" is the energy required to move an electron from the Fermi lever to the conduction band edge, and kT is the absolute temperature multiplied by Boltzman's constant. "$\nu_0$" may be assumed to have a value of approximately $10^{12}$ attempts per second in most solids. For a Fermi level position of 0.9 eV (midgap) the emission time of charge carriers from the trap is therefore calculated to be $4\times10^3$ seconds at room temperature. This slow escape time means that it takes approximately 1.2 hours for a charge carrier to vacate the trap. Obviously, an electrophotographic photoreceptor cannot tolerate such a slow charge carrier discharge rate. If, for example, electrons, once trapped, remain confined for such a lengthy period of time, a large concentration of electrons trapped at the photoconductor layer/top protective layer interface will build up with repeated use of the photoreceptor and this space charge and the positive charge accumulated on the surface of the top protective layer will create a very high electric field distortion across said top protective layer, which field causes the top protective layer to "breakdown". As used herein, "breakdown" refers to the inability of the top protective layer to inhibit the flow of charge carriers therethrough.

Applicants have discovered that this breakdown phenomena can be eliminated by reducing the number of defect states which give rise to deep charge carrier traps. As taught in applicant's U.S. patent application Ser. No. 580,081, filed Feb. 14, 1984 and entitled "An Improved Method Of Making A Photoconductive Member And Improved Photoconductive Member Made Thereby", the addition of an "enhancement layer" operatively disposed between the top protective layer and the photoconductive layer beneficially affects the performance of an electrophotographic device incorporating that layer. While at the time of filing said U.S. patent application Ser. No. 580,081, the reason for the physical behavior of the enhancement layer was unknown, Applicants now have determined that the addition of the enhancement layer (as fabricated in the manner taught therein) operated to reduce the escape time of charge carriers caught in deep traps previously encountered at the interface of the photoconductive layer by reducing the overall density of defect states in the semiconductor alloy material from which the enhancement layer was formed. However, the enhancement layer described in the aforementioned copending application, decreased the overall density of defect states by depositing intrinsic semiconductor alloy material by r.f. glow discharge rather than by microwave glow discharge (since microwave deposition tends to create additional defect states). Therefore, the enhancement layer of said aforementioned application relied upon a reduction in the overall density of defect states present in undoped semiconductor alloy material to aid in reducing the number of deep traps in which charge carriers could be caught in order to reduce charge fatigue. However, no attempt or even suggestion of how to optimize the chemical composition of the enhancement layer in order to further prevent charge carriers from being caught in the deep midgap traps was discussed or suggested in said application.

In the parent of the subject application, application Ser. No. 769,106 filed Aug. 26, 1985, now abandoned, the discussion centered upon the optimization of the enhancement layer so as to prevent charge carrier fatigue and improve the operational cycling time of positively charged electrophotographic devices incorporating said optimized enhancement layer. Moreover, by utilizing the disclosure found therein, negative charge carriers were substantially inhibited from falling into the deep midgap traps. Only relatively shallow defect states remain in which those negative charge carriers may be trapped and the rate of emission of charge carriers from these shallow traps can be measured in terms of seconds or fractions of a second rather than in terms of days. Therefore, in its broadest form, the '106 application related to the positioning of the Fermi level of the semiconductor alloy material from which the enhancement layer is formed to a position closer to the conduction band than at midgap. This prevented the deep midgap states from being occupied by electrons and thus being effective as electron traps. In this way electrons moving through the enhancement layer did not have to pass through a region in which there are effective unoccupied deep midgap traps. This translated into an electron escape time of less than about 1 second for a 1.8 eV silicon:hydrogen:fluorine:phosphine alloy having the Fermi thereof positioned in the most favored range of 0.75 to 0.65 eV from the conduction band. Because of the quick release time there was no substantial build up of trapped charge in this region and therefore no high field distortion.

It is noteworthy that the subject inventors did not claim to have invented the concept of fixing the Fermi level of the amorphous semiconductor alloy material from which one of the operative layers of an electrophotographic photoreceptor is fabricated. Rather, said inventors claimed to be the first to recognize that it is possible to substantially prevent charge carriers from being caught in deep midgap traps by pinning the Fermi level of the semiconductor alloy material from which the enhancement layer is fabricated at a point approximately 0.8 to 0.5 eV from the conduction band.

However, said '106 application was limited to moving and fixing the Fermi-level of the enhancement layer of electrophotographic media having a positive charge placed on the outer surface thereof. The subject invention is directed toward the movement and pinning of the Fermi-level of the enhancement layer of electrophotographic media which is adapted for use with a negative charge placed on the outer surface thereof. In the case of the subject invention, the Fermi-level of the enhancement layer is moved and pinned at about 0.75 to 0.45 eV of the valence band (as compared to 0.8 to 0.5 eV of the conduction band edge in the case of the positively charged media). The difference in the distance from the respective band edge at which the respective Fermi-levels are positioned and pinned, depending upon whether a positive or negative charge is being applied to the external surface of the electrophotographic media, is due to the higher density of defect states which exists in the band tail adjacent to the valence band, vis-a-vis, the conduction band tail of amorphous silicon alloys.

Applicants' discovery is to be sharply contrasted to a technique described by Mort, et al in a paper entitled "Field-effect Phenomena in Hydrogentated Amorphous Silicon Photoreceptors" published in the Journal of Applied Physics, Apr. 16, 1984 at page 3197. In this paper, Mort, et al describe a process for the elimination of field effect in photoreceptors, which process was accomplished by the proper doping of the a-Si:H-insulator interface. Mort, et al observed Fermi level motion under the influence of the field generated by corona charging of the electrophotographic photoreceptor, the deleterious effects of which they proposed to counteract by doping. More particularly, Mort, et al proposed the addition of a boron-doped trapping layer interposed between the top surface of the photoconductive layer and the insulating layer (the top protective layer) for quenching the effects of the electric field and removing the effect of "field-induced blurring" (commonly referred to as "image-flow"). In this manner, Mort, et al were able to counteract the problem of "image-flow".

However, Mort, et al were not concerned with and failed to address the concurrently present problem of "charge fatigue". Moreover, Mort, et al, by adding boron dopant, shifted the Fermi level of the semiconductor alloy material toward the valence band for a positively charged media. By so shifting the Fermi level of the semiconductor alloy material, Mort, et al left deep midgap states unoccupied by electrons, which states consequently form deep electron trapping cites. These deep traps are capable of capturing electrons generated either by light exposure or by being swept out of the photoconductive layer during corona charging, thereby creating the electric field distortion which is responsible for the problem of charge fatigue and which the subject application attempts to avoid. Note that Mort, et al specifically prohibit the use of phosphorous doping to shift the Fermi level of the enhancement layer toward the conduction band because such a shift would make the semiconductor alloy material thereof more conductive, thereby causing just the type of lateral electron flow they seek to avoid. Further, there is no disclosure, whatsoever, in Mort, et al for pinning the Fermi-level of the enhancement layer in that shifted position.

In contrast thereto, applicants first intentionally dope the semiconductor alloy material of the enhancement layer which is interposed between the photoconductive layer and the top protective layer in order to shift the Fermi level thereof toward one of the bands, (depending upon the polarity of the charge placed on the surface of the media). By so shifting the Fermi level of the semiconductor alloy material, the charge carriers do not have to move through and become caught in the deep midgap states present in the energy gap thereof. This substantially eliminates the problems of charge fatigue by keeping the charge carriers out of the deep midgap states. Applicants then introduce both boron dopant and phosphorus dopant so as to pin the Fermi level at that preselected position in the energy gap through the addition of defect states on both sides of the pinned Fermi level. The added defect states, being shallow, do not cause charge fatigue problems; but those states are sufficient to pin the Fermi level, so as to prevent its field induced movement when the photoreceptor is charged, hence image flow is also inhibited.

As should accordingly be apparent from the foregoing discussion, while Mort, et al propose a solution to the problem of image flow in electrophotographic media, they fail to consider the problem of charge fatigue which their solution to image flow inherently invokes. The subject invention, on the other hand, solves both problems by first appropriately shifting and then pinning the Fermi level of the semiconductor alloy material of a newly added enhancement layer.

In light of the many definitions utilized for the terms "amorphous" and "microcrystalline" in the scientific and patent literature it will be helpful to clarify the definition of those terms as used herein. The term "amorphous", as used herein, is defined to include alloys or materials exhibiting long range disorder, although said alloys or materials may exhibit short or intermediate range order or even contain crystalline inclusions. As used herein the term "microcrystalline" is defined as a unique class of said amorphous materials characterized by a volume fraction of crystalline inclusions, said volume fraction of inclusions being greater than a threshold value at which the onset of substantial changes in certain key parameters such as electrical conductivity, band gap and absorption constant occur. It is to be noted that pursuant to the foregoing definitions, the microcrystalline, materials employed in the practice of the instant invention fall within the generic term "amorphous" as defined hereinabove.

The concept of microcrystalline materials exhibiting a threshold volume fraction of crystalline inclusions at which substantial charges in key parameters occur, can be best understood with reference to the percolation model of disordered materials. Percolation theory, as applied to microcrystalline disordered materials, analogizes properties such as the electrical conductivity manifested by microcrystalline materials, to the percolation of a fluid through a non-homogeneous, semi-permeable medium such as a gravel bed.

Microcrystalline materials are formed of a random network which includes low mobility, highly disordered regions of material surrounding randomized, highly ordered crystalline inclusions or grains having high carrier mobility. Once these crystalline inclusions attain a critical volume fraction of the network, (which critical volume will depend, inter alia, upon the size and/or shape and/or orientation of the inclusions), it becomes a statistical probability that said inclusions are sufficiently interconnected so as to provide a low resistance current path through the network. Therefore at this critical or threshold volume fraction, the material exhibits a sudden increase in conductivity. This analysis (as described in general terms relative to electrical conductivity herein) is well known to those skilled in solid state theory and may be similarly applied to describe additional physical properties of microcrystalline materials, such as optical gap, absorption constant, etc.

The onset of this critical threshold value for the substantial change in physical properties of microcrystalline materials will depend upon the size, shape and orientation of the particular crystalline inclusions, but is relatively constant for different types of materials. It should be noted that while many materials may be broadly classified as "microcrystalline" those materials will not exhibit the properties Applicants have found advantageous for the practice of the subject invention unless they have a volume fraction of crystalline inclusions which exceeds the threshold value necessary for substantial change. Accordingly, we have defined "microcrystalline materials" to include only those materials which have reached the threshold value. Further note that the shape of the crystalline inclusions is critical to the volume fraction necessary to reach the threshold value. There exist 1-D, 2-D and 3-D models which predict the volume fraction of inclusions necessary to reach the threshold value, these models being dependent on the shape of the crystalline inclusions. For instance, in a 1-D model (which may be analogized to the flow of charge carriers through a thin wire), the volume fraction of inclusions in the amorphous network must be 100% to reach the threshold value. In the 2-D model (which may be viewed as substantially conically shaped inclusions extending through the thickness of the amorphous network), the volume fraction of inclusions in the amorphous network must be about 45% to reach the threshold value. And finally in the 3-D model (which may be viewed as substantially spherically shaped inclusions in a sea of amorphous material), the volume fraction of inclusions need only be about 16–19% to reach the threshold value. Therefore, amorphous materials (even materials classified as microcrystalline by others in the field) may include crystalline inclusions without being microcrystalline as that term is defined herein.

These and other objects and advantages of the instant invention will be apparent from the detailed description of the invention, the brief description of the drawings and the claims which follow.

BRIEF SUMMARY OF THE INVENTION

There is disclosed herein electrophotographic media comprising an electrically conductive substrate, a bottom layer overlying the substrate which is adapted to block the free flow of charge carriers from the substrate, a photoconductive layer overlying the bottom layer which is adapted to discharge an electrostatic charge, an enhancement layer overlying the photoconductive layer which is adapted to substantially reduce the number of charge carriers caught in deep midgap traps, said enhancement layer formed of intentionally p-doped semiconductor alloy material so as to move the Fermi level thereof to within 0.75 to 0.45 eV of the valence band, the semiconductor alloy material from which said enhancement layer is formed having its Fermi level pinned and a top protective layer overlying the enhancement layer which is adapted to protect the photoconductive layer from ambient conditions and aid in the transport of charge carriers under illumination. The bottom blocking layer is preferably formed of a doped microcrystalline semiconductor alloy material which is selected from the group consisting essentially of chalcogens, amorphous silicon alloys, amorphous germanium alloys, amorphous silicon-germanium alloys, photoconductive organic polymers and combinations thereof. The enhancement layer is preferably fabricated from a material selected from the group consisting essentially of amorphous silicon alloys, amorphous germanium alloys and amorphous silicon-germanium alloys. In a yet more preferred embodiment, the Fermi level of the enhancement layer is moved to within 0.6 to 0.7 eV of the valence band. In this manner, the enhancement layer is fabricated from a material which has been specifically tailored so as to provide for the thermal emission of charge carriers from traps at the interface thereof with the top protective layer in approximately one second or less. The thickness of the enhancement layer is approximately 2,500 to 10,000 angstroms and preferably about 5,000 angstroms. The Fermi level of the enhancement layer may be pinned at a given location from the valence band. The pinning of the Fermi level may be accomplished by including both phosphorus and boron, in about equal amounts, in the semiconductor alloy matrix for adding shallow states at the energy gap of the semiconductor matrix so as to pin said Fermi level at a preselected position.

There is further disclosed herein a method of preventing charge fatigue in electrophotographic media of the type which include an electrically conductive substrate, a bottom charge injection blocking layer, a photoconductive layer and a top protective layer. The method includes the steps of forming an enhancement layer from an intentionally p-doped semiconductor alloy material in which the Fermi level is moved to within 0.75 to 0.45 eV of the valence band, pinning the Fermi level of the semiconductor alloy material from which the enhancement layer is formed and operatively disposing said enhancement layer between the photoconductive layer and the top protective layer so that the enhancement layer is adapted to substantially decrease the number of charge carriers caught in deep midgap traps as charge carriers approach the interface between said enhancement layer and the top protective layer. The method includes the further steps of forming the back blocking layer from a microcrystalline, boron doped silicon:hydrogen:fluorine alloy, the extent of boron doping being sufficient to make the material degenerate and (2) forming the enhancement layer from a material selected from the group consisting essentially of amorphous silicon alloys, amorphous germanium alloys and amorphous silicon-germanium alloys. In the preferred embodiment, the further step is included of moving the Fermi level of the enhancement layer to within 0.7 to 0.6 eV of the valence band. In this manner, the material from which the enhancement layer is fabricated is tailored so as to provide for the emission of charge carriers from said traps in approximately one second or less. The method may still include the further step of forming the enhancement layer to be approximately 2,500 to 10,000 angstroms thick and preferably approximately 5,000 angstroms thick. In the most preferred embodiment, the Fermi level of the semiconductor alloy material from which the enhancement layer is fabricated is pinned by introducing both boron and phosphorus, in about equal amounts, into the host semiconductor matrix thereof so as to add additional shallow states at both sides of the Fermi level in the energy gap thereof.

BRIEF DESCRIPTION OF THE DRAWINGS

FIG. 1 is a partial cross-sectional view of an electrophotographic photoreceptor which includes the improved enhancement layer of the instant invention; and, FIG. 2 is a schematic, cross-sectional view of a microwave glow discharge deposition apparatus as adapted for the manufacture of electrophotographic photoreceptors such as illustrated in FIG. 1;

DETAILED DESCRIPTION OF THE DRAWINGS

Referring now to FIG. 1, there is illustrated in a partial cross-sectional view, a generally cylindrically shaped electrophotographic photoreceptor 10 of the type incorporating all of the innovative principles disclosed within the specification of the instant invention. The photoreceptor 10 includes a generally cylindrically shaped substrate 12 formed, in this embodiment, of aluminum, although other nondeformable metals such as stainless steel could also be employed as a preferred embodiment. The periphery of the aluminum substrate 12 is provided with a smooth, substantially defect free surface by any well known technique such as diamond machining and/or polishing. Disposed immediately atop the deposition surface of the substrate 12 is deposited a doped layer 14 of microcrystalline semiconductor alloy material which has been specifically designed and adapted to serve as the bottom blocking layer for said photoreceptor 10. In keeping with the teachings disclosed in commonly assigned U.S. Pat. No. 4,582,773, the blocking layer 14 is formed of highly doped, highly conductive microcrystalline semiconductor alloy material. Disposed immediately atop the bottom blocking layer 14 is the photoconductive layer 16 which may be formed from a wide variety of photoconductive materials. Among some of the preferred materials are doped intrinsic amorphous silicon alloys, amorphous germanium alloys, amorphous silicon-germanium alloys, chalcogenide materials and organic photoconductive polymers. Disposed atop the photoconductive layer 16 is the improved enhancement layer 18 of the subject invention, said enhancement layer specifically designed to substantially reduce the problem of charge fatigue, as well as image flow, as described in the Background section of this specification. Finally, the photoreceptor 10 includes a top protective layer 19 operatively disposed atop the enhancement layer 18, which protective layer 19 (1) protects the upper surface of the photoconductive layer 16 from ambient conditions and (2) separates the charge stored on the surface of the photoreceptor 10 from charge carriers photogenerated in the photoconductive layer 16.

In accordance with the principles of the first embodiment of the instant invention, the improved enhancement layer 18 is formed of an intentionally p-doped semiconductor alloy material. The purpose of intentionally p-doping the enhancement layer 18 is to move the Fermi level closer to the valence band (in the case of a negative surface charge) of the semiconductor alloy material from which said layer is fabricated. Obviously, in the case of a negative surface charge, it would be desirable to intentionally dope the enhancement layer 18 so as to move the Fermi level of the semiconductor alloy material from which it is fabricated closer to the conduction band. A wide variety of semiconductor alloy materials may be employed from which to fabricate the enhancement layer 18. Among some of the favored materials are silicon:hydrogen alloys, silicon:hydrogen:halogen alloys, germanium:hydrogen alloys, germanium:hydrogen:halogen alloys, silicon:germanium:hydrogen alloys, and silicon:hydrogen:halogen alloys. Among the halongenated materials, fluorinated alloys are particularly preferred. Some such alloys having utility herein are disclosed in U.S. Pat. No. 4,217,374 of Ovshinsky, et al entitled Amorphous Semiconductors Equivalent to Crystalline Semiconductors, U.S. Pat. No. 4,226,898 of Ovshinsky, et al entitled Amorphous Semiconductors Equivalent to Crystalline Semiconductors Produced By A Glow Discharge Process and U.S. patent application Ser. No. 668,435 filed Nov. 5, 1984 of Yang, et al entitled Boron Doped Semiconductor Materials And Method For Producing Same, now U.S. Pat. No. 4,624,862. These patents and applications are assigned to the asignee of the instant invention and the disclosures thereof are incorporated herein by reference.

Doping of the semiconductor alloy material may be accomplished by any technique and employing any material which is well known to those of ordinary skill in the art. Because applicants' previous enhancement layers, as described in said U.S. patent aplication Ser. No. 580,081, were prepared with a reduced density of defect states, the charge carriers moving through that layer from the photoconductive layer 16 to neutralize charge located at the surface of the top protective layer 19 were not caught in as many deep midgap traps. The result was a reduction in the number of carriers which required the aforedescribed lenghty period of time in order to be emitted from the deep traps. By employing the principles espoused in the subject application and employing an enhancement layer 18, the Fermi level of which is moved to a desired location and pinned so that charge carriers are able to avoid the deep midgap states present in the silicon alloy material from which the layer is fabricated, the residency time of charge carriers caught in traps is significantly decreased since only shallow traps are accessible to those carriers. The absence of deeply trapped charge carriers not only prevents a breakdown of the top protective layer 20, but significantly increases the cycle time within which the electrophotographic medium 10 is capable of recovering lost surface charge and readying itself for reproducing a further copy.

While a wide variety of semiconductor materials may be employed from which to fabricate the photoconductive layer 16, the amorphous silicon alloys, amorphous germanium alloys and amorphous-silicon germanium alloys have been found to be particularly advantageous. Such alloys and methods for their preparation are disclosed in the patents and applications referred to and incorporated by reference hereinabove.

The conductivity type of the materials from which the blocking layer 14 and the photoconductive layer 16 are fabricated, are chosen so as to establish a blocking contact therebetween whereby injection of unwanted charge carriers into the bulk of the photoconductive layer 16 is effectively inhibited. In cases where the photoreceptor 10 is adapted to be electrostatically charged with a negative surface charge, the bottom blocking layer 14 will preferably be fabricated from a heavily n-doped alloy and the photoconductive layer 16 will be fabricated from an intrinsic semiconductor layer, a lightly n-doped semiconductor layer or a p-doped semiconductor layer. It should be noted that intrinsic, or lightly doped semiconductor layers are generally favored for the fabrication of the photoconductive layer 16 insofar as such materials will have a lower rate of thermal charge carrier generation than will more heavily doped materials. Layers of intrinsic semiconductor alloy materials are most preferably favored insofar as such layers have the lowest number of defect states per unit volume and the most favorable discharge characteristics.

The maximum electrostatic voltage which the photoreceptor 10 can sustain ($V_{sat}$) will depend upon the efficiency of the blocking layer 14 as well as the thickness of the photoconductive layer 16. For a given blocking layer efficiency, a photoreceptor 10 having a thicker photoconductive layer 16 will sustain a greater voltage. For this reason, charging capacity or charge acceptance is generally referred to in terms of volts per micron thickness of the photoconductive layer 16. For economy of fabrication and elimination of stress it is generally desirable to have the total thickness of the photoconductive layer 16 be 25 microns or less. It is also desirable to have as high a static charge maintained thereupon as possible. Accordingly, gains in barrier layer efficiency, in terms of volts per micron charging capacity, translate directly into improved overall photoreceptor preformance. It has routinely been found that photoreceptors structured in accordance with the principles of the instant invention are able to sustain voltages of greater than 50 volts per micron on up to a point nearing the dielectric breakdown of the semiconductor alloy material.

The intentionally doped semiconductor alloy material of the enhancement layer of the instant invention is producable by a wide variety of deposition techniques, all of which are well known to those skilled in the art. Said deposition techniques include, by way of illustration, and not limitation, chemical vapor deposition techniques, photoassisted chemical vapor deposition techniques, sputtering, evaporation, electroplating, plasma spray techniques, free radical spray techniques, and glow discharge deposition techniques.

At present, glow discharge deposition techniques have been found to have particular utility in the fabrication of the enhancement layer of the instant invention. In glow discharge deposition processes, a substrate is disposed in a chamber maintained at less than atmospheric pressure. A process gas mixture including a precursor of the semiconductor alloy material (and dopants) to be deposited is introduced into the chamber and energized with electromagnetic energy. The electromagnetic energy activates the precursor gas mixture to form ions and/or radicals and/or other activated species thereof which species effect the deposition of a layer of semiconductor material upon the substrate. The electromagnetic energy employed may be dc energy, or ac energy such as radio frequency or microwave energy. Such glow discharge techniques are detailed in said patent applications, incorporated by reference hereinabove.

Microwave energy has been found particularly advantageous for the fabrication of electrophotographic photoreceptors insofar as it allows for the rapid, economical preparation of successive layers of high quality semiconductor alloy material. Referring now to FIG. 2, there is illustrated a cross-sectional view of one particular apparatus 20 adapted for the microwave energized deposition of layers of semiconductor material onto a plurality of cylindrical drums or substrate members 12. It is in an apparatus of this type that the electrophotographic photoreceptor 10 of FIG. 1 may be advantageously fabricated. The apparatus 20 includes a deposition chamber 22, having a pump-out port 24 adapted for suitable connection to a vacuum pump for removing reaction products from the chamber and maintaining the interior thereof at an appropriate pressure to facilitate the deposition process. The chamber 22 further includes a plurality of reaction gas mixture input ports 26, 28 and 30 through which reaction gas mixtures are introduced into the deposition environment.

Supported within the chamber 22 are a plurality of cylindrical drums or substrate members 12. The drums 12 are arranged in close proximity, with the longitudinal axes thereof disposed substantially mutually parallel and the outer surfaces of adjacent drums being closely spaced apart so as to define an inner chamber region 32. For supporting the drums 12 in this manner, the chamber 22 includes a pair of interior upstanding walls, one of which is illustrated at 34. The walls support there-across a plurality of stationary shafts 38. Each of the drums 12 is mounted for rotation on a respective one of the shafts 38 by a pair of disc shaped spacers 42 having outer dimensions corresponding to the inner dimension of the drums 12, to thereby make frictional engagement therewith. The spacers 42 are driven by a motor and chain drive, not shown, so as to cause rotation of the cylindrical drums 12 during the coating process for facilitating uniform deposition of material upon the entire outer surface thereof.

As previously mentioned, the drums 12 are disposed so that the outer surfaces thereof are closely spaced apart so as to form the inner chamber 32. As can be noted in FIG. 2, the reaction gases from which the deposition plasma will be formed are introduced into the inner chamber 32 through at least one of the plurality of narrow passages 52 formed between a given pair of adjacent drums 12. Preferrably, the reaction gases are introduced into the inner chamber 32 through every other one of the narrow passages 52.

It can be noted in the figure each pair of adjacent drums 12 is provided with a gas shroud 54 connected to one of the reaction gas input ports 26, 28 and 30 by a conduit 56. Each shroud 54 defines a reaction gas reservoir 58 adjacent to the narrow passage through which the reaction gas is introduced. The shrouds 54 further include lateral extensions 60 which extend from opposite sides of the reservoir 58 and along the circumfrence of the drums 12 to form narrow channel 62 between the shroud extension 60 and the outer surfaces of the drums 12. The shrouds 54 are configured as described above so as to assure that a large percentage of the reaction gas will flow into the inner chamber 32 and maintain uniform gas flow along the entire lateral extent of the drums 12.

As can also be noted in the figure, narrow passages 66 which are not utilized for reaction gas introduction into the chamber 32 are utilized for removing reaction products from the inner chamber 32. When the pump coupled to the pump out port 24 is energized, the interior of the chamber 22 and the inner chamber 32 is pumped out through the narrow passages 66. In this manner reaction products can be extracted from the chamber 22, and the interior of the inner chamber 32 can be maintained at a suitable pressure for deposition.

To facilitate the production of precursor free radicals and/or ions and/or other activated species from the process gas mixture, the apparatus further includes a microwave energy source, such as a magnetron with a waveguide assembly or an antenna, disposed so as to introduce microwave energy into the inner chamber 32. As depicted in FIG. 3, the apparatus 20 includes a window 96 formed of a microwave permeable material such as glass or quartz. The window 94 in addition to enclosing the inner chamber 32, allows for dispostion of the magnetron or other microwave energy source exteriorly of the chamber 22, thereby isolating it from the environment of the process gas mixture.

During the deposition process it may be desirable to maintain the drums 12 at an elevated temperature. To that end, the apparatus 20 may further include a plurality of heating elements, not shown, disposed so as to heat the drums 12. For the deposition of amorphous semiconductor alloys the drums are generally heated to a temperature between 20° C. and 400° C. and preferrably about 225° C.

EXAMPLE

In this example, an electrophotographic photoreceptor was fabricated in a microwave energized glow discharge deposition system generally similar to that depicted with reference to FIG. 2. A cleansed aluminum substrate was first operatively positioned in the deposition apparatus and then the chamber was evacuated and a gas mixture comprising 0.15 SCCM (standard cubic centimeters per minute) of about a 20% mixture of $PF_5$ in hydrogen; 75 SCCM of 1000 ppm $SiH_4$ in hydrogen and 45 SCCM of hydrogen was introduced thereinto. The pumping speed was constantly adjusted to maintain a total pressure of approximately 100 microns in the chamber while the substrate was maintained at a temperature of approximately 300° C. A bias of +80 volts was established by disposing a charged wire in the plasma region. Microwave energy of 2.45 GHz was introduced into the deposition region. These conditions resulted in the deposition of the bottom blocking layer of phosphorous doped microcrystalline silicon:hydrogen:fluorine alloy material. The deposition rate was approximately 20 Angstroms per second and the deposition continued until the phosphorous doped microcrystalline blocking layer obtained a total thickness of approximately 7000 Angstroms.

At this point the microwave energy was terminated, and the reaction gas mixture flowing therethrough was changed to a mixture comprising 0.5 SCCM of a 0.18% mixture of $BF_3$ in hydrogen; 30 SCCM of $SiH_4$; 4 SCCM of $SiF_4$ and 40 SCCM of hydrogen. Pressure was maintained at 50 microns and microwave energy of 2.45 GHz was introduced into the apparatus. This resulted in the deposition of a layer of lightly p-doped amorphous silicon:hydrogen:fluorine alloy material. The deposition of this alloy material (which formed the photoconductive layer of the electrophotographic medium) occured at a rate of approximately 200 Angstroms per second and continued until approximately 20 microns of the amorphous silicon alloy material was deposited.

In order to deposit the amorphous silicon alloy from which the improved enhancement layer of the subject invention is fabricated, it is necessary to add sufficient amounts of boron obtained from boron-trifluoride so as to move the Fermi level of the deposited alloy to approximately 0.7 to 0.6 eV from the valence band thereof. This movement was accomplished by terminating the microwave energy and adding 0.05 SCCM of about a 0.18% mixture of $BF_3$ in hydrogen to the gas mixture specified in the preceeding paragraph for fabricating the photoconductive layer. In order to both accomplish this Fermi level movement and fix the Fermi level at this position so as to avoid splitting said level upon illumination, approximately equal quantities of about 0.1 SCCM of a 20% mixture of $PF_5$ in hydrogen and 0.1 SCCM of a 20% mixture of boron-trifluoride gas in hydrogen are further introduced into the precursor gas mixture during the deposition step so that the Fermi level has been moved to the 0.7 to 0.6 eV range and simultaneously pinned thereat. The remainder of the deposition parameters are kept the same as in the foregoing paragraph so that the enhancement layer is deposited at a rate of approximately 200 Angstroms per second and to a thickness of about 5000 Angstroms.

A top protective layer of an amorphous silicon:carbon:hydrogen:fluorine alloy is deposited atop the improved enhancement layer. A gas mixture comprising 2

SCCM of $SiH_4$, 30 SCCM of $CH_4$ and 2 SCCM of $SiF_4$ is introuced into the deposition apparatus for depositing this layer. Next, the microwave energy source is energized and the deposition of a layer of amorphous silicon:hydrogen:fluorine:carbon occured at a rate of approximately 40 Angstroms per second. Deposition continued until approximately 5000 Angstroms of the protective layer was deposited at which time the microwave energy was terminated, the substrate was cooled to 100° C., the apparatus was raised to atmospheric pressure and the thus prepared electrophotographic photoreceptor was removed for testing.

It should be understood that numerous modifications and variations should be made to the foregoing within the scope of the instant invention. While the foregoing example was oriented toward electrophotographic photoreceptors formed of amorphous silicon alloy materials, the instant invention is obviously not so limited but may be utilized in conjunction with the fabrication of photoreceptors which include a wide variety of photoconductive material such as chalcogenide photoconductive materials as well as organic photoconductive materials. The blocking layers, discussed herein, may be fabricated from a wide variety of microcrystalline semiconductor alloy materials in keeping in spirit of the instant invention.

The preceeding drawings, description, discussion and examples are merely meant to be illustrative of the instant invention and are not meant to be limitations upon the practice thereof. It is the following claims, including all equivalents, by which applicants define the instant invention.

We claim:

1. An electrophotographic medium comprising:

an electrically conductive substrate;

a bottom layer overlying the substrate, the bottom layer adapted to block the free flow of charge carriers from the substrate;

a photoconductive layer overlying the bottom layer, the photoconductive layer adapted to discharge an electrostatic charge;

an enhancement layer fabricated from a semiconductor alloy material selected from the group consisting of: amorphous silicon alloys, amorphous germanium alloys, and amorphous silicon-germanium alloys; said enhancement layer overlying the photoconductive layer and adapted to substantially reduce the number of charge carriers caught in deep mid-gap traps for preventing charge fatigue; said semiconductor alloy material is intentionally boron-doped so as to move the Fermi level thereof to within about 0.75 to 0.45 eV of the valence band to avoid said deep trapping and prevent image flow;

the semiconductor alloy material from which said enhancement layer is formed having the Fermi level thereof pinned by the addition of boron and phosphorous; and a top protective layer overlying the enhancement layer, said protective layer adapted to protect the photoconductive layer from ambient conditions.

2. A medium as in claim 1, wherein the photoconductive layer is fabricated from a material selected from the group consisting of: chalcogenide photoconductors, amorphous silicon alloys, amorphous germanium alloys, amorphous silicon-germanium alloys, photoconductive organic polymers and combinations thereof.

3. A medium as in claim 1, wherein the bottom blocking layer is formed of a doped microcrystalline semiconductor alloy material.

4. A medium as in claim 3, wherein the microcrystalline bottom blocking layer is fabricated from a material selected from the group consisting of: silicon alloys, germanium alloys and silicon-germanium alloys.

5. A medium as in claim 4, wherein said microcrystalline back blocking layer is fabricated from a phosphorous doped silicon:hydrogen:fluorine alloy.

6. A medium as in claim 4, wherein said microcrystalline back blocking layer is sufficiently doped so as to become substantially electrically degenerate.

7. A medium as in claim 1, wherein the Fermi level of the enhancement layer is moved to within approximately 0.6 to 0.7 eV of the conduction band.

8. A medium as in claim 1, wherein the enhancement layer is fabricated from an amorphous semiconductor alloy material which has been specifically tailored so as to provide for the emission of charge carriers from traps at the interface thereof with the top protective layer in approximately one second or less.

9. A medium as in claim 1, wherein the thickness of the enhancement layer is approximately 2500 to 10,000 angstroms.

10. A medium as in claim 9, wherein the thickness of the enhancement layer is approximately 5,000 angstroms.

* * * * *